US009282821B2

(12) United States Patent
Miedtke

(10) Patent No.: US 9,282,821 B2
(45) Date of Patent: Mar. 15, 2016

(54) RACK ASSEMBLY

(71) Applicant: Scott Robert Miedtke, Maple Grove, MN (US)

(72) Inventor: Scott Robert Miedtke, Maple Grove, MN (US)

( * ) Notice: Subject to any disclaimer, the term of this patent is extended or adjusted under 35 U.S.C. 154(b) by 95 days.

(21) Appl. No.: 13/669,849

(22) Filed: Nov. 6, 2012

(65) Prior Publication Data

US 2014/0125211 A1 May 8, 2014

(51) Int. Cl.
*A47F 3/06* (2006.01)
*A47B 88/00* (2006.01)

(52) U.S. Cl.
CPC ..... *A47B 88/0014* (2013.01)

(58) Field of Classification Search
CPC ..... A47F 3/06; A47F 3/063; A47B 77/16; A47B 88/0485; A47B 63/02
USPC ..... 312/330.1, 334.27, 334.29, 334.31, 312/334.32, 334.35, 126–132; 108/143; 211/126.15, 41.11, 42, 43, 184, 74
See application file for complete search history.

(56) References Cited

U.S. PATENT DOCUMENTS 526,625 A * 9/1894 Hulbert ..... 312/131
637,361 A * 11/1899 Suters ..... 312/131
827,649 A 7/1906 Murphy
1,604,995 A * 11/1926 Gruhler ..... 211/162
2,491,652 A * 12/1949 Feerick ..... 211/71.01
2,559,203 A * 7/1951 Weiskopf ..... 312/334.35
2,826,475 A * 3/1958 Larson ..... 312/330.1
3,561,595 A * 2/1971 Weggeland ..... 206/757
3,841,477 A * 10/1974 Stark et al. ..... 206/557
4,192,439 A 3/1980 Segal
4,254,872 A * 3/1981 Garrett ..... 206/561
4,653,818 A 3/1987 DeBruyn
4,714,305 A 12/1987 Service
D320,141 S 9/1991 Farrell
D325,849 S 5/1992 Melcher
5,244,272 A 9/1993 Thompson
5,671,987 A 9/1997 Hommes
5,687,893 A * 11/1997 Jacobsmeyer, Jr. ..... 224/275
5,720,547 A 2/1998 Baird
5,871,107 A 2/1999 Johnson et al.
D406,218 S 3/1999 Schneider
D413,035 S 8/1999 Weterrings et al.
D413,491 S 9/1999 McCauley
5,957,558 A 9/1999 Quade
D414,992 S 10/1999 Schmidt
D426,117 S 6/2000 Howitt
D437,165 S 2/2001 Goodman et al.
D468,162 S 1/2003 Martin
D471,048 S 3/2003 Piatt
D483,233 S 12/2003 Chen
6,659,576 B1 * 12/2003 Welch ..... 312/334.41
D490,259 S 5/2004 Schumann et al.
D494,775 S 8/2004 Birmingham
D495,929 S 9/2004 Clarson (Continued)

OTHER PUBLICATIONS

Swivel Store Instructions, Merchant Media, LLC, 2011, 1 page.

*Primary Examiner* — Janet M Wilkens
(74) *Attorney, Agent, or Firm* — David D. Brush; Westman, Champlin & Koehler, P.A.

(57) ABSTRACT

A rack assembly has a shelf attached to a slidable mount. A front wall and a back wall are mounted to the shelf. At least one elastic element extends between the front wall and the back wall above a left side and a right side of the shelf such that the front wall, back wall and at least one elastic element define a contained area capable of holding objects.

19 Claims, 11 Drawing Sheets

(56) References Cited

U.S. PATENT DOCUMENTS

| | | | | |
|---|---|---|---|---|
| D501,337 | S | 2/2005 | Berger et al. | |
| D526,533 | S | 8/2006 | Burnett et al. | |
| 7,237,686 | B2 | 7/2007 | Bertrand et al. | |
| 7,275,647 | B1 | 10/2007 | Thompson | |
| 7,306,301 | B2 | 12/2007 | Walburn | |
| D561,539 | S | 2/2008 | Snider et al. | |
| 7,469,791 | B2 | 12/2008 | Phoy | |
| D593,810 | S | 6/2009 | Goodman et al. | |
| 7,631,770 | B2 | 12/2009 | Martin | |
| D650,203 | S | 12/2011 | Klein et al. | |
| D650,636 | S | 12/2011 | Roth | |
| D652,684 | S | 1/2012 | Herrera | |
| 8,109,581 | B1 | 2/2012 | Lazenby | |
| 2008/0283477 | A1* | 11/2008 | Wamsley et al. | 211/4 |
| 2010/0270246 | A1* | 10/2010 | Rodriguez | 211/34 |
| 2012/0049713 | A1* | 3/2012 | Tingle et al. | 312/334.33 |
| 2012/0298604 | A1* | 11/2012 | Fuhrer et al. | 211/78 |

* cited by examiner

RACK ASSEMBLY

BACKGROUND

In cabinets, it can be difficult to reach some items because they are stacked behind other items. To overcome this, pullout drawers and shelving have been introduced that allow items to be pulled out of the cabinet on the drawers or shelving, thereby giving more direct access to the items.

The discussion above is merely provided for general background information and is not intended to be used as an aid in determining the scope of the claimed subject matter. The claimed subject matter is not limited to implementations that solve any or all disadvantages noted in the background.

SUMMARY

A rack assembly has a shelf attached to a slidable mount. A front wall and a back wall are mounted to the shelf. At least one elastic element extends between the front wall and the back wall above a left side and a right side of the shelf such that the front wall, back wall and at least one elastic element define a contained area capable of holding objects.

Shelves have a first shelf and a second shelf in parallel with the first shelf. An elastic element retains items so that the items do not fall off the first shelf but allows the items to extend out from the first shelf to make contact with the second shelf.

A bin has a slide mount for mounting within a cabinet. A bottom plate is attached to the slide mount such that the bottom plate can slide out of the cabinet. A front plate is mounted to the bottom plate and extends upward from the bottom plate. A back plate is mounted to the bottom plate and extends upward from the bottom plate. An elastic band extends around a front of the front plate and a back of the back plate.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

In prior art pullout shelves and drawers, the sidewalls of the pullout shelves and drawers are rigid. As a result, the shelves or drawers do not accommodate items that are slightly bigger than the width of the shelf or drawer. In addition, the rigidity of the sidewalls can make it more difficult to insert items into a crowded shelf since these sidewalls will not bend outward to accommodate an additional item. To overcome this, the present inventors have created pullout or slidable shelving that includes elastic side elements that can bend outward to accommodate items on the shelving but that also prevent items on the shelving from falling off the shelving.

Figure 1:
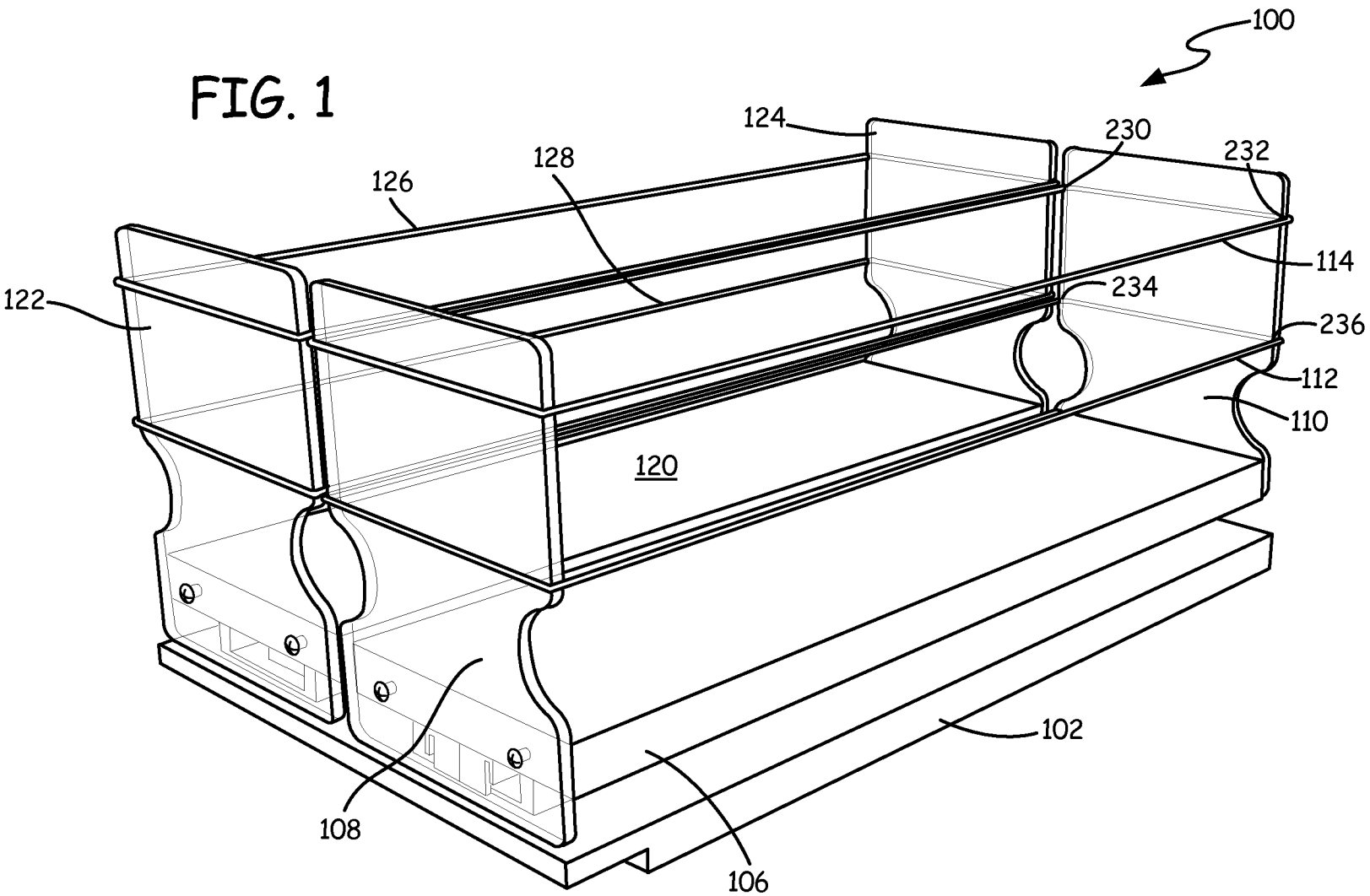
FIG. 1 is perspective view of a first embodiment of a rack assembly.
Figure 2:
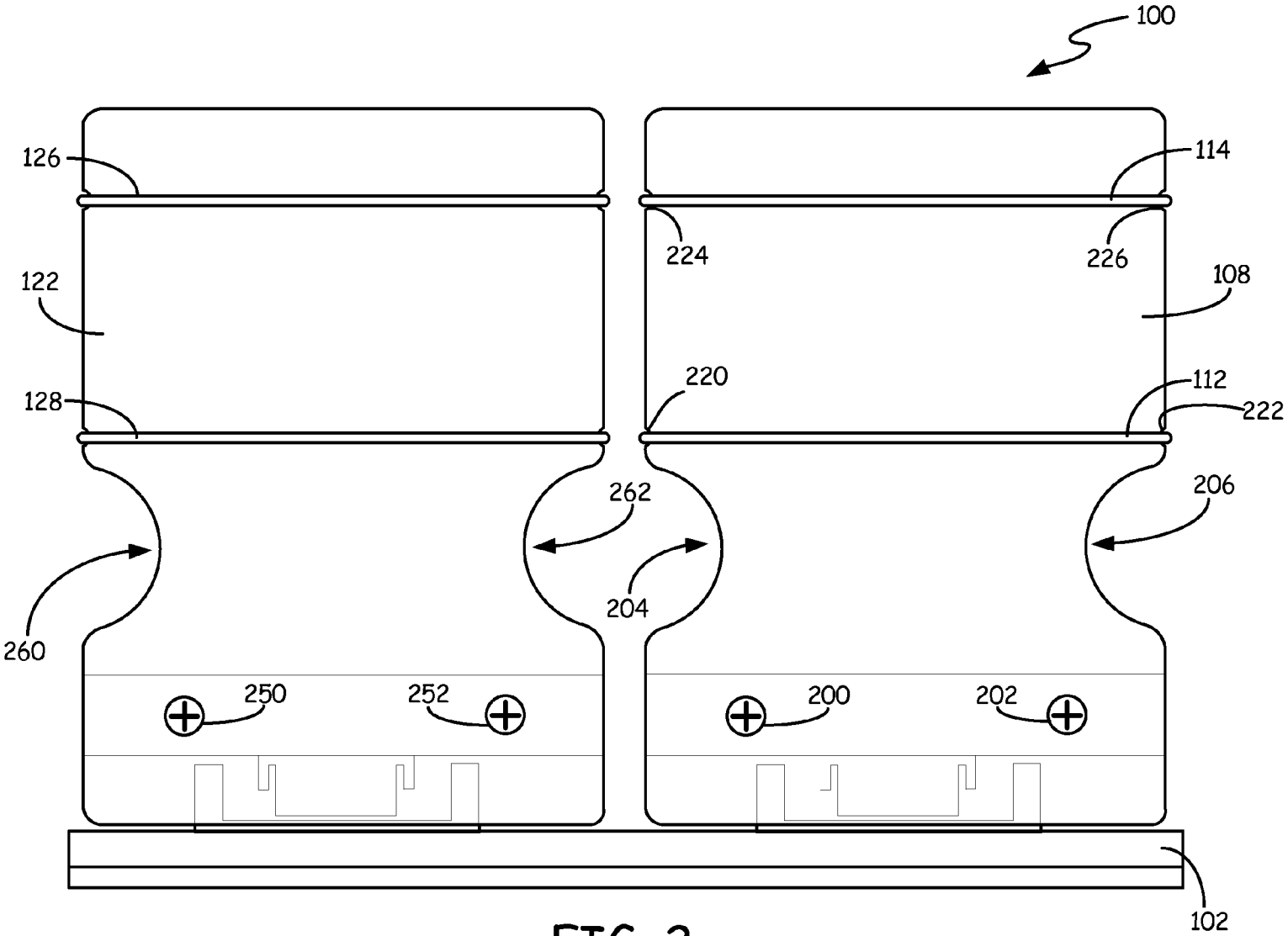
FIG. 2 is a front view of the rack assembly of FIG. 1.
Figure 3:
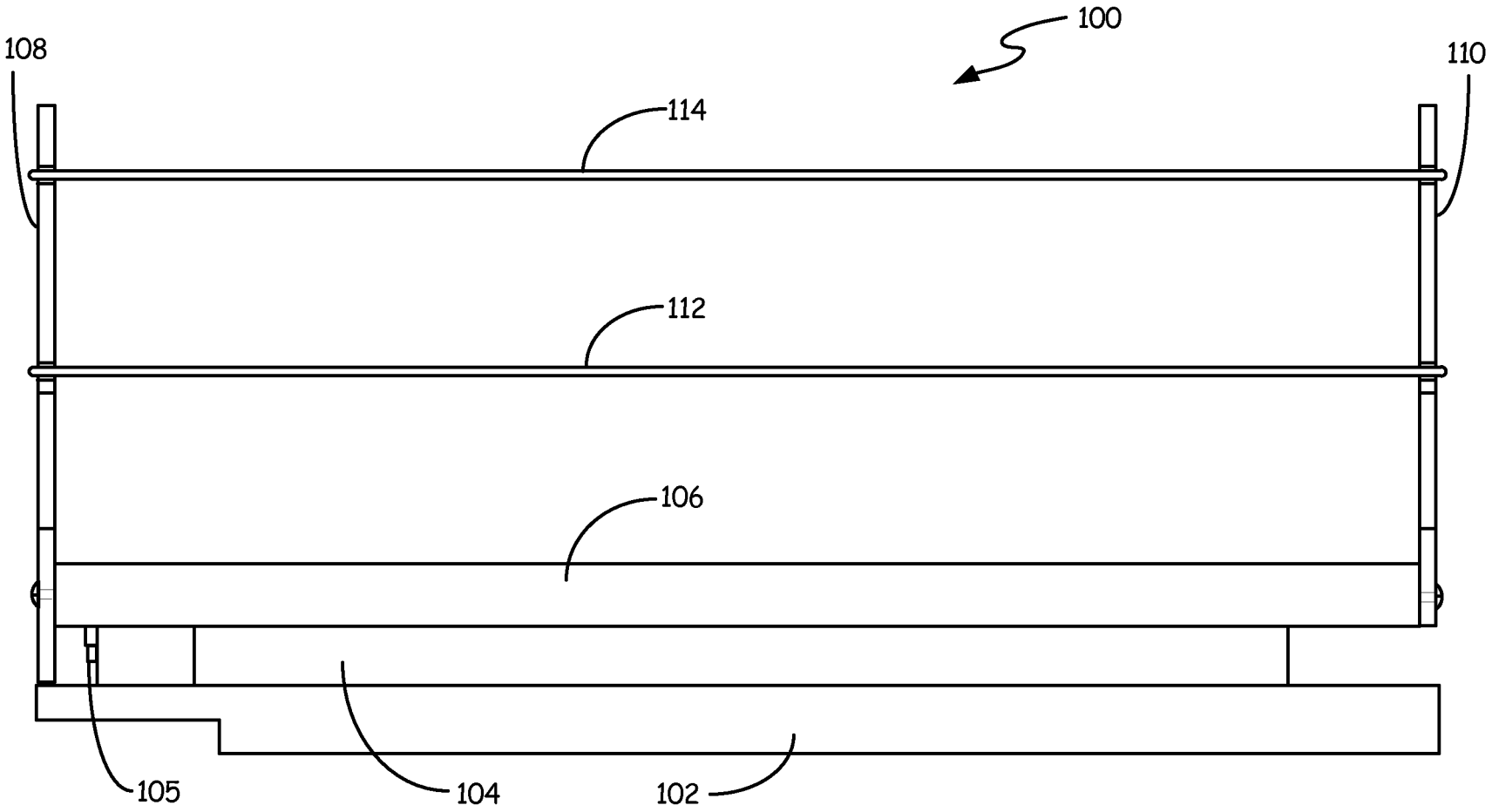
FIG. 3 is a side view of the rack assembly of FIG. 1.
Figure 4:
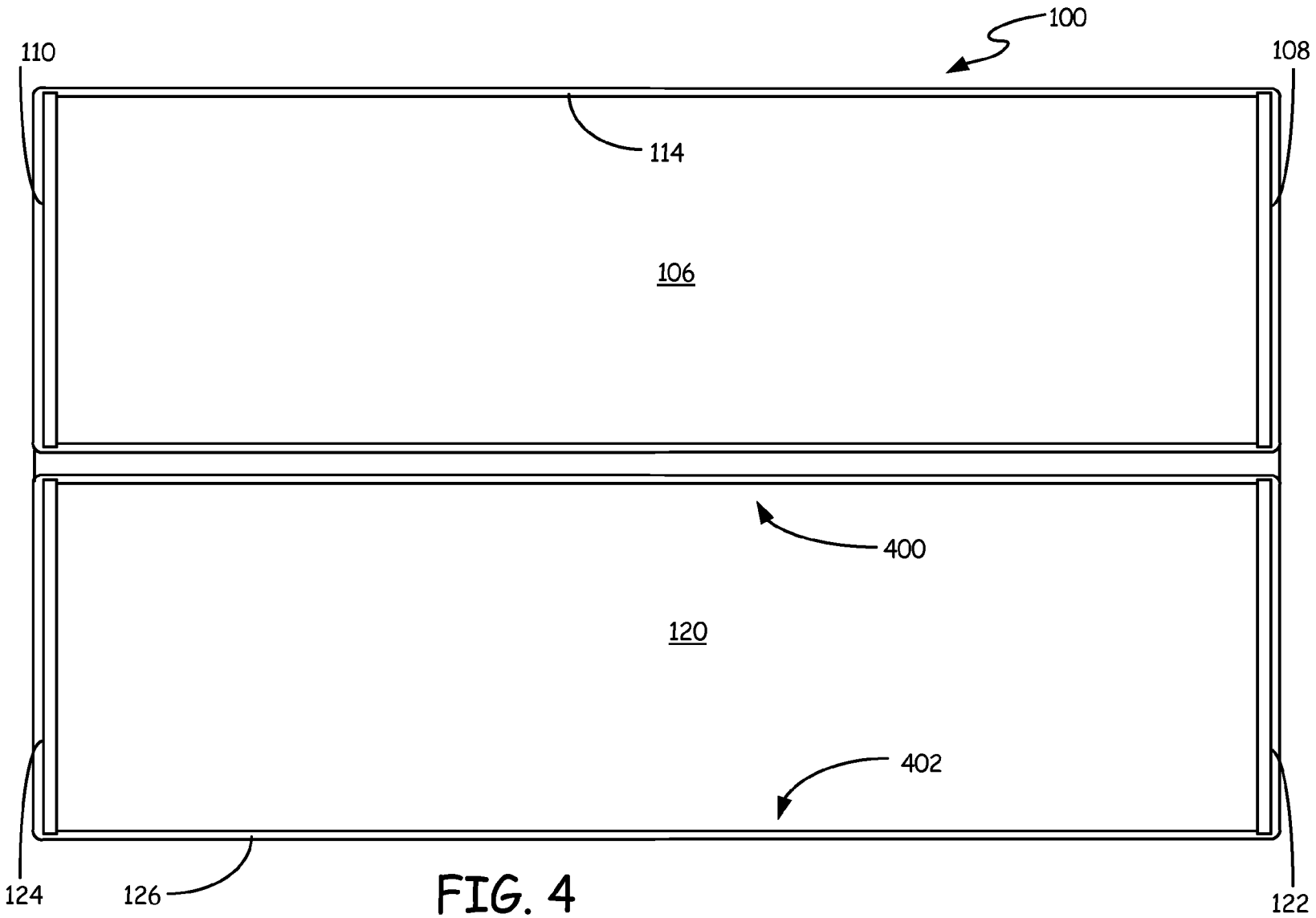
FIG. 4 is a top view of the rack assembly of FIG. 1.
Figure 5:
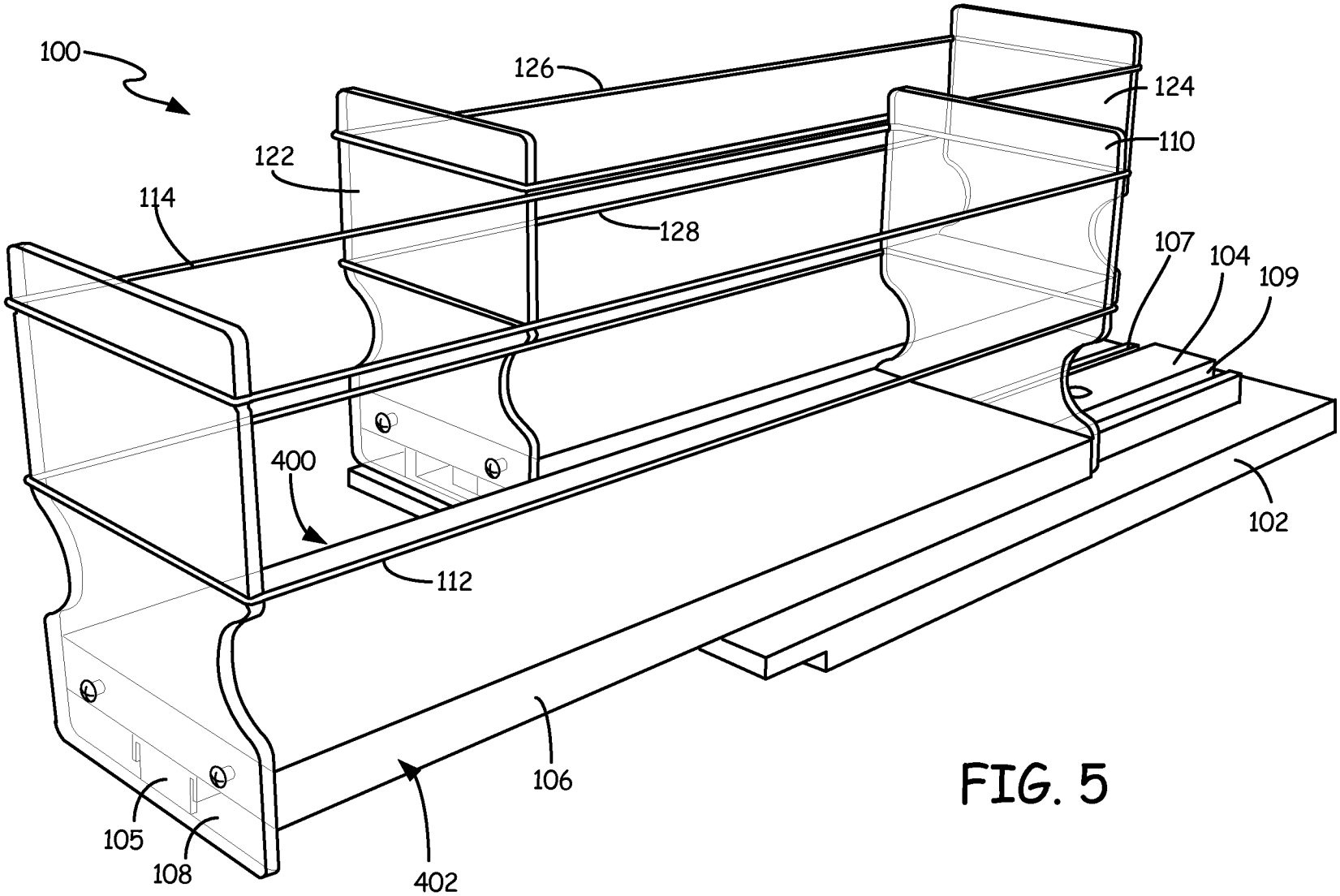
FIG. 5 is a perspective view of the rack assembly of FIG. 1 with one shelf slid outward.

FIG. 1 provides a perspective view of one embodiment of a rack assembly 100. FIGS. 2, 3 and 4 provide a front, right side and top view of rack assembly 100 of FIG. 1. FIG. 5 provides a perspective view of rack assembly 100 of FIG. 1 with one shelf slid outward. The left side view of rack assembly 100 is a mirror image of the right side view of FIG. 3.

Rack assembly (also referred to as a bin or shelves) 100 includes a base 102 configured to be mounted to a shelf within a cabinet. A slidable mount or slide mount 104 is mounted to base 102 and includes one or more ball bearing elements that allow a slide arm 105 to move along tracks 107 and 109. A shelf or bottom plate 106 is attached to arm 105 and as such, can also slide along tracks 107 and 109.

Shelf 106 has a front end that is attached to a front plate 108, also referred to as a front wall or a front panel, which extends upward from shelf 106. In one embodiment, front plate 108 is attached to shelf 106 with two screws 200 and 202. Front plate 108 includes two recesses 204 and 206 on opposite sides of front plate 108 that are positioned below two elastic elements 112 and 114. A back of shelf 106 is connected to a back plate 110, also referred to as a back wall or back panel, which extends upward from shelf 106. Elastic elements 112 and 114 extend between front plate 108 and back plate 110. In one embodiment, elastic elements 112 and 114 are elastic bands that extend around the front surface of front plate 108 and around the back surface of back plate 110 and extend above left side 400 and right side 402 of shelf 106. Elastic elements 112 and 114 fit within notches such as notches 220, 222, 224 and 226 in front plate 108 and notches 230, 232, 234 and 236 in back plate 110. The notches maintain elastic elements 112 and 114 at a desired height along front plate 108 and back plate 110. Elastic bands 112 and 114 are space apart vertically to provide two levels of lateral support to objects on shelf 106.

Elastic elements 112 and 114 may be elastically displaced toward the center of shelf 106 or outwardly beyond sides 400 and 402 of shelf 106. Since elastic elements 112 and 114 are resilient, they will exert a force to return to the state shown in FIGS. 1-5 if they are pushed inward or outward.

Rack assembly 100 also includes a second shelf 120 that is similarly positioned on a slide mount that is parallel to slide mount 104 such that shelf 120 may be slid along a track of the slide mount and out of a cabinet. Shelf 120 is in parallel with shelf 106 such that a line from the front to back of shelf 106 along a side of shelf 106 is parallel to a line from font to back of shelf 120 along a side of shelf 120. Shelf 120 is attached to front plate 122 and back plate 124 in a similar fashion as front plate 108 and back plate 110 are attached to shelf 106. Elastic bands 126 and 128 extend around the front of front plate 122 and around the back of back plate 124 and are positioned within notches in those plates. Elastic bands 126 and 128 are resilient and will exert a counteracting force when displaced to the sides of shelf 120.

Front plate 122 is attached to shelf 120 by fasteners such as fasteners 250 and 252. Front plate 122 includes two recesses 260 and 262 where recess 262 cooperates with recess 204 of front plate 108 to create a space that is large enough for a person's finger to fit between front plate 122 and front plate 108. Specifically, when the front surfaces of front plate 108 and front plate 120 are aligned in a same plane, the space created by recesses 262 and 204 allow a finger to be inserted between front plate 122 and front plate 108. This allows the user to pull on either front plate 122 or front plate 108 to slide shelf 120 or shelf 106 out from the cabinet. In accordance with one embodiment, recesses 204 and 262 have an interior radius of 0.5 inches and are located 1.7 inches from the base of their respective front plate. In accordance with one embodiment, front plates 108 and 122 and back plates 110 and 124 are made of polyethylene terephthalate glycol-modified (PETG) and are transparent to provide a better view of items stored on shelves 106 and 120.

Front plate 108, back plate 110 and elastic elements 112 and 114 define a contained area capable of holding items or objects. Elastic elements 112 and 114 retain items so that they do not fall off shelf 106 but allow the items to extend out from shelf 106 so that the items can make contact with shelf 120. Thus, elastic elements 112 and 114 may be stretched by items or objects on shelf 106 sufficiently for items on shelf 106 to make contact with shelf 120. In some cases, elastic bands 126 and 128 are stretched by items extend from shelf 106 to shelf 120. Front plate 122, back plate 124 and elastic bands 126 and 128 define a second contained area capable of holding additional objects where elastic bands 126 and 128 retain items on shelf 120 so they do not fall off shelf 120 but allow the items on shelf 120 to extend off the side of shelf 120 so that items on shelf 120 may make contact with shelf 106.

Figure 6:
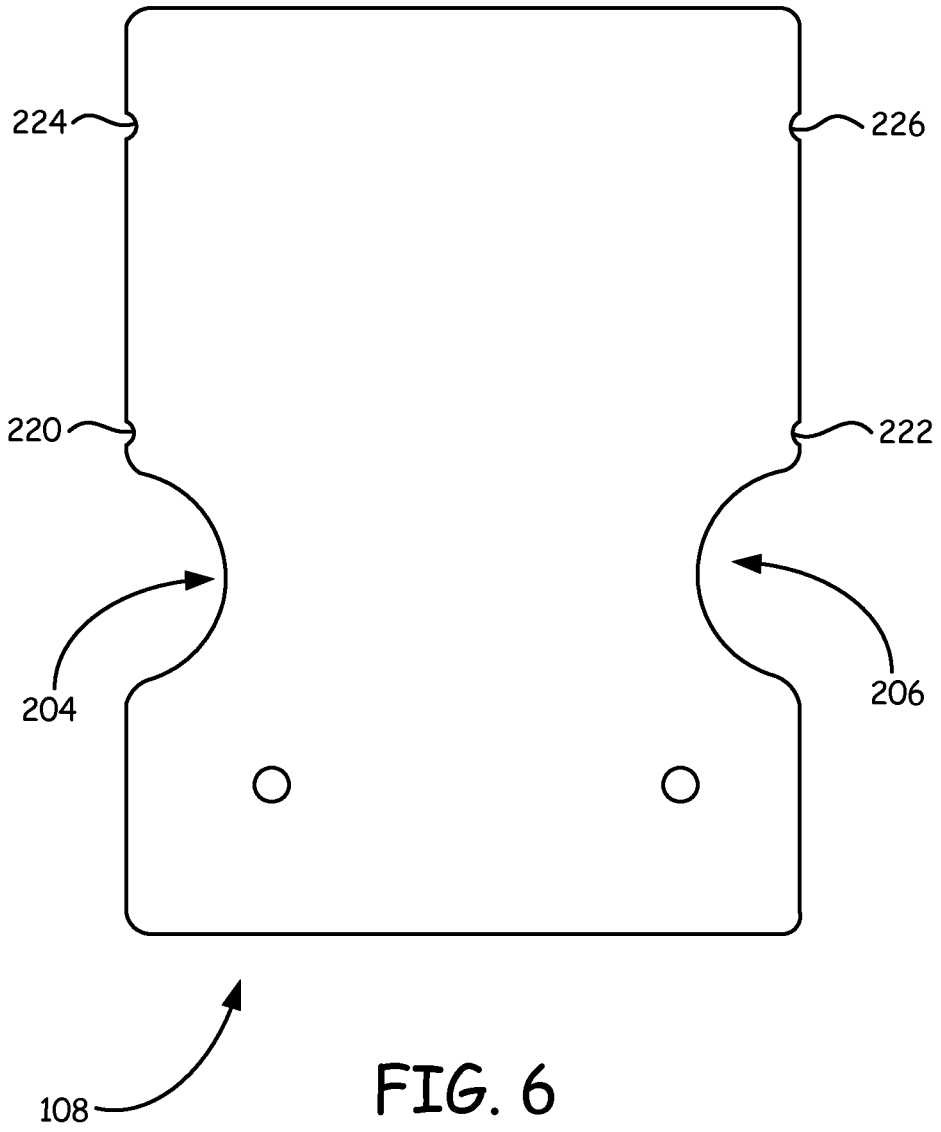
FIG. 6 is a front view of a front panel.
Figure 7:
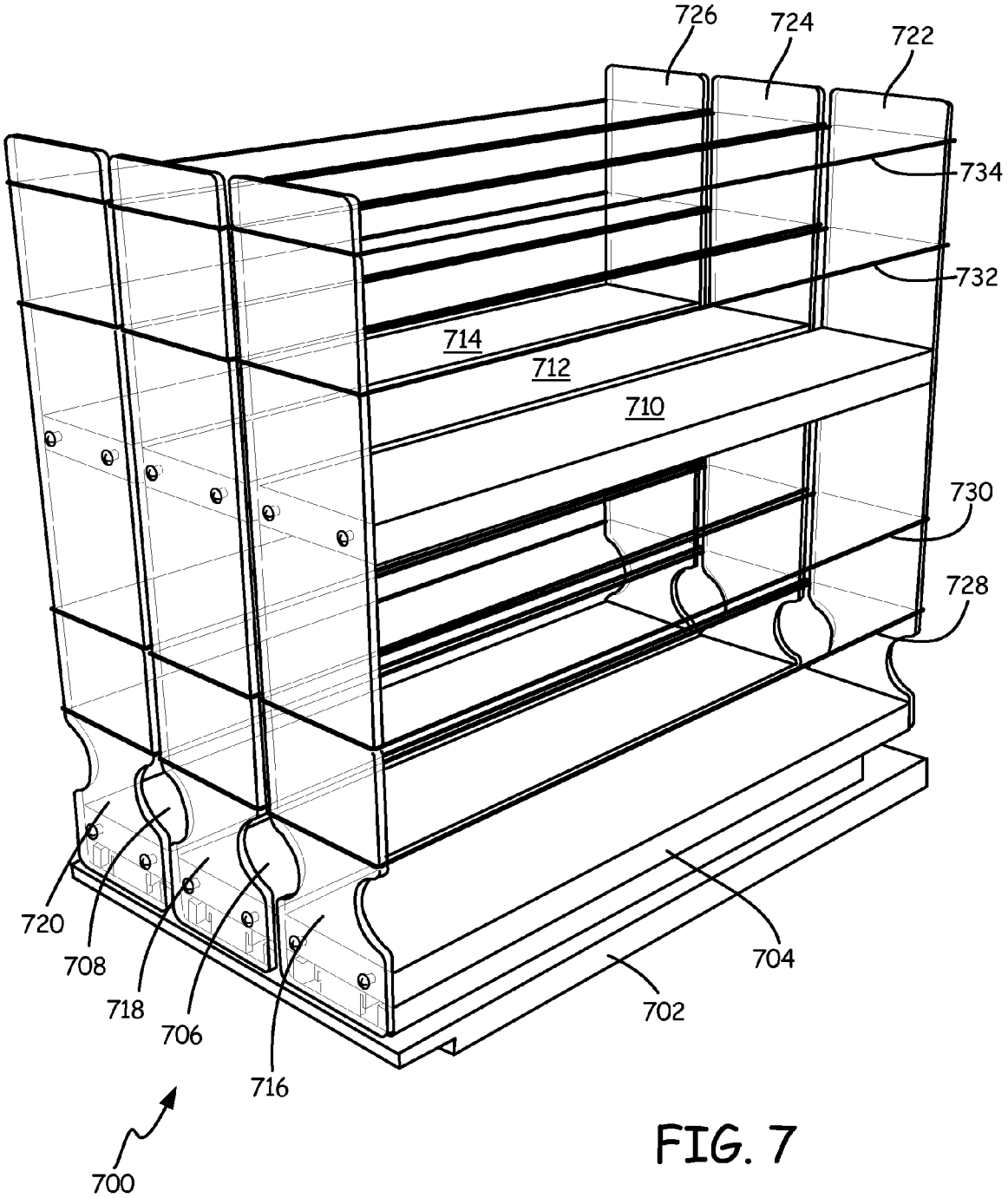
FIG. 7 is a perspective view of a second embodiment of a rack assembly.

FIG. 6 provides a front view of front plate 108 in isolation. In FIG. 6, the notches used to hold elastics elements 112 and 114 are shown more clearly as notches 600, 602, 604 and 606. In accordance with some embodiments, each notch is a half circle with a radius of 0.05 inches. In other embodiments, the notches have other shapes and sizes.

FIGS. 7, 8, 9 and 10 provide a front perspective view, a front view, a right side view and top view, respectively, of a second embodiment of a rack assembly (also referred to as a bin or shelves) 700. The left side view of rack assembly 700 is the mirror image of the right side view of FIG. 9. Rack assembly 700 includes a base 702 having slide mounts 824, 826 and 828 mounted thereon. Shelves 704, 706 and 708 are mounted to slide mounts 824, 826 and 828 such that shelves 704, 706 and 708 may be slid outward from base 702 when base 702 is mounted within a cabinet.

Figure 8:
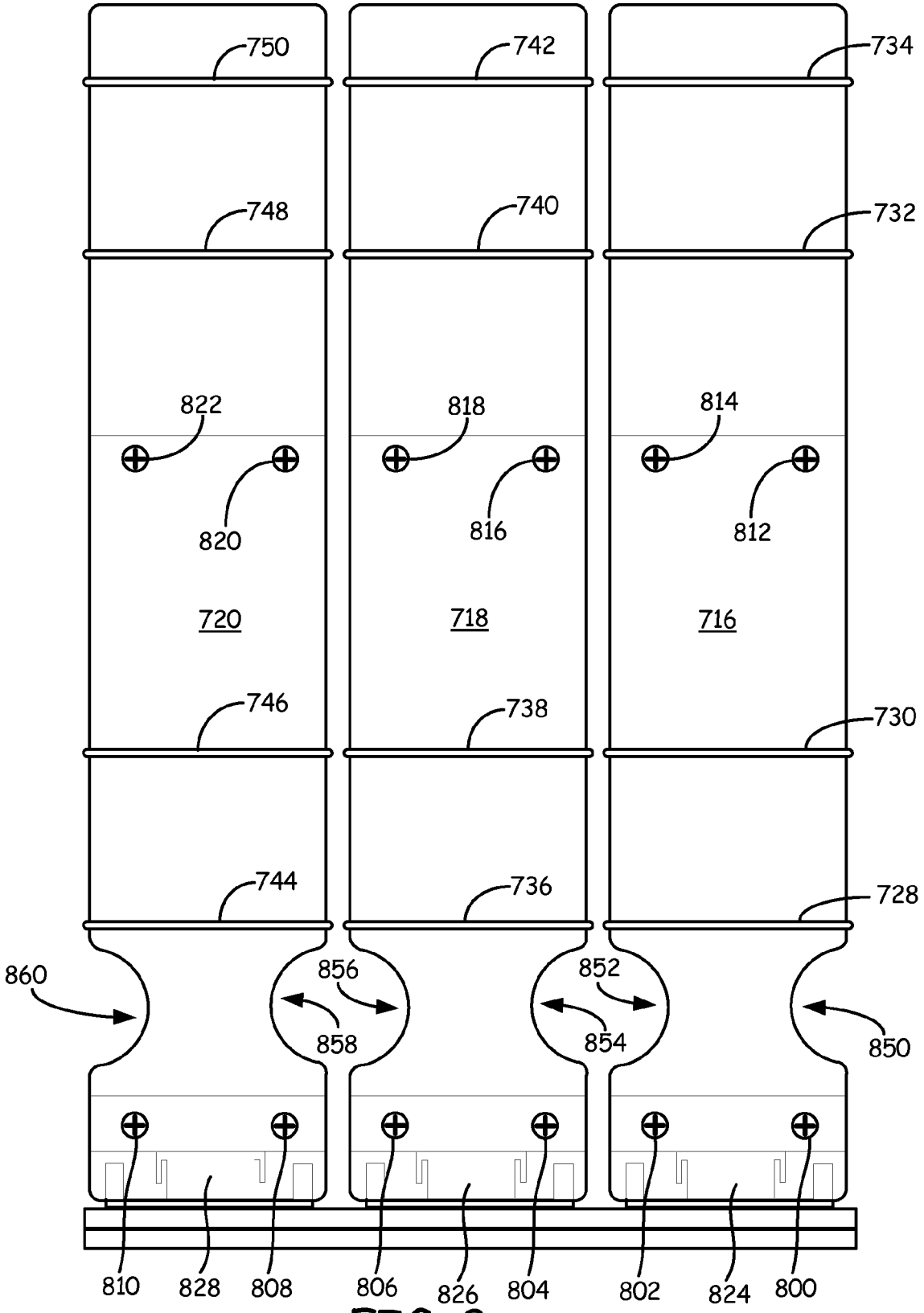
FIG. 8 is a front view of the rack assembly of FIG. 7.
Figure 9:
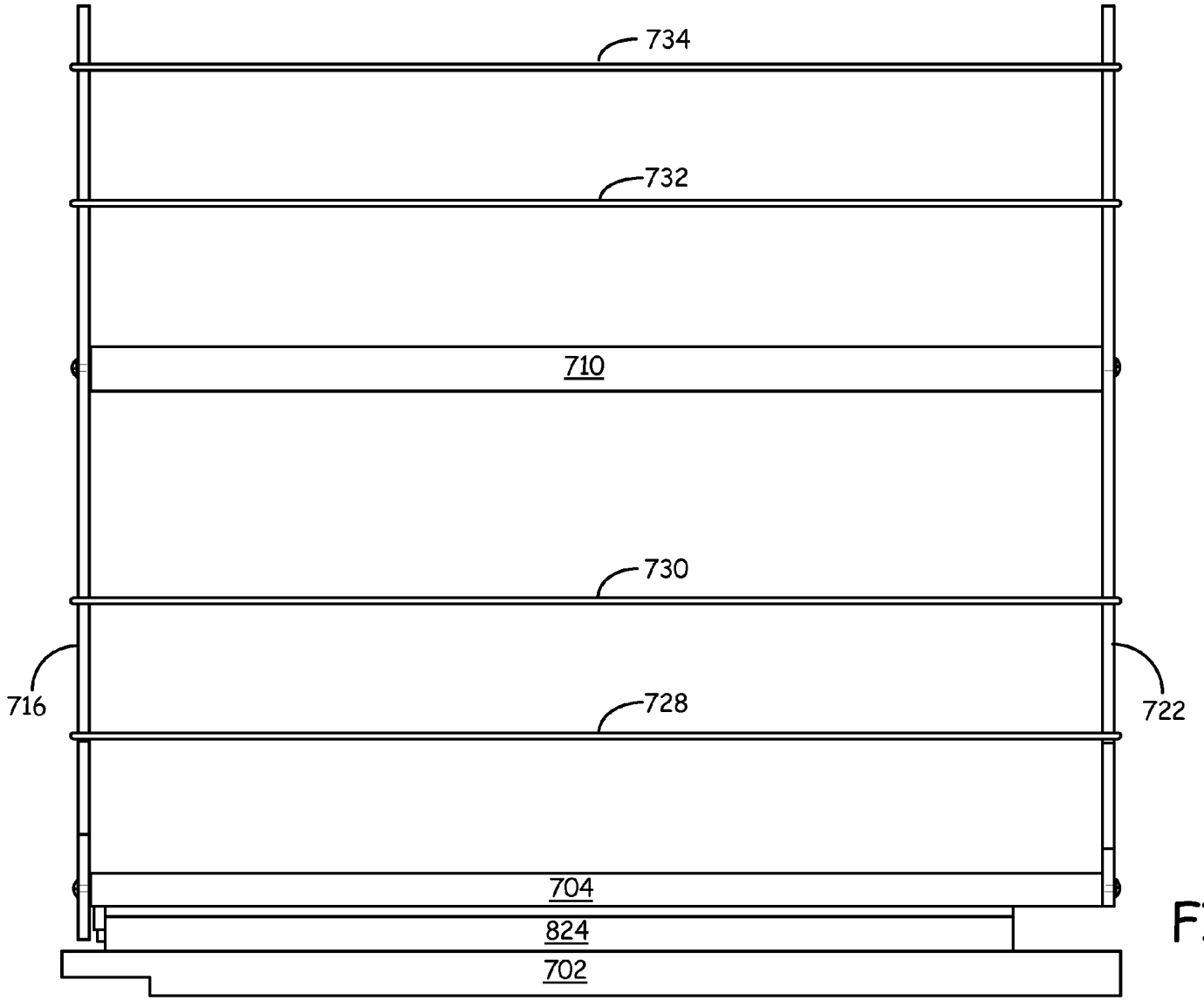
FIG. 9 is a side view of the rack assembly of FIG. 7.
Figure 10:
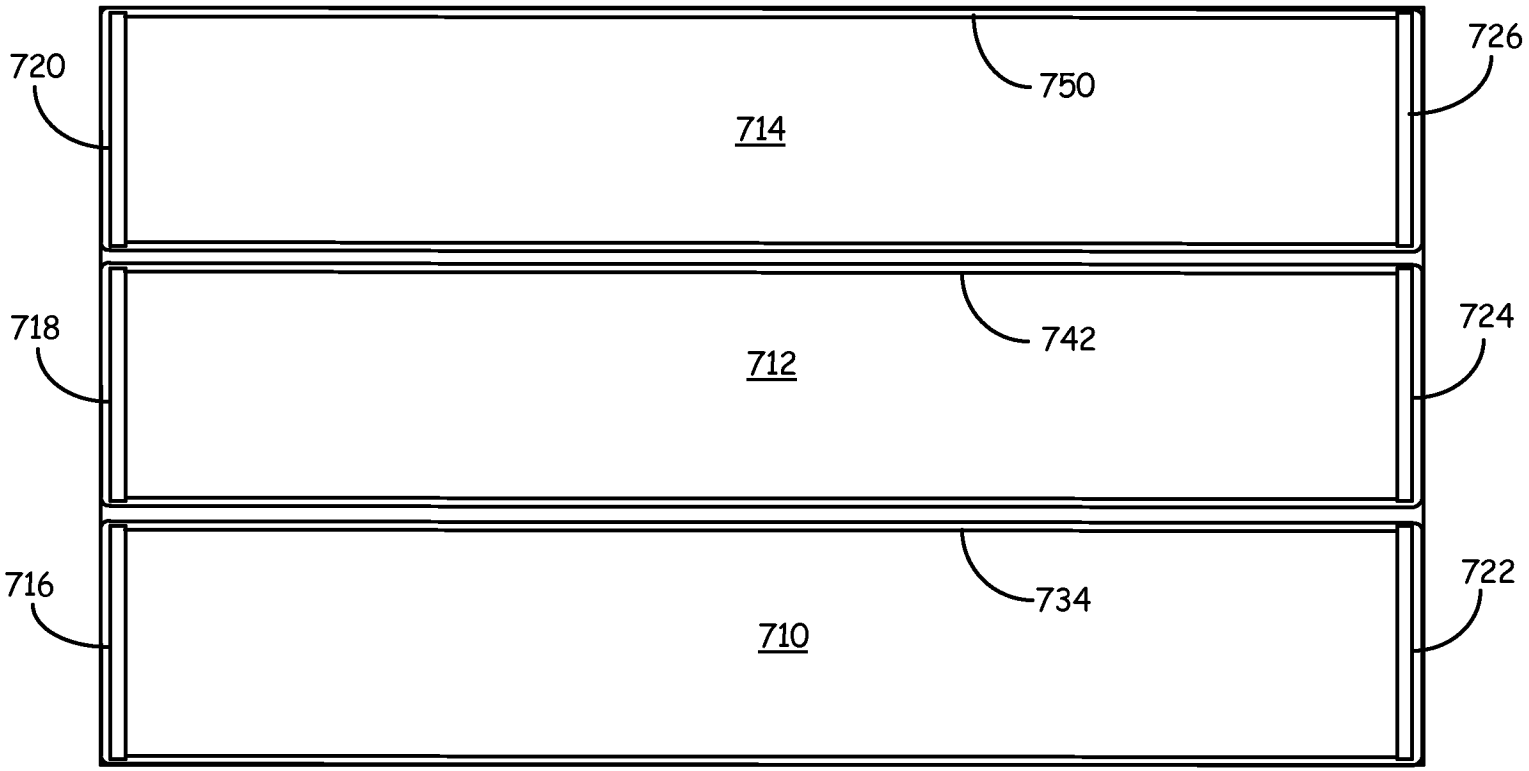
FIG. 10 is a top view of the rack assembly of FIG. 7.

A front plate 716 and a back plate 722 are attached to shelf 704; a front plate 718 and a back plate 724 are attached to shelf 706; and a front plate 720 and a back plate 726 are attached to shelf 708. Under some embodiments, the front plates are attached to the shelves using fasteners such as screws 800, 802, 804, 806, 808 and 810 as shown in FIG. 8. Front plates 716, 718 and 720 each include pairs of recesses 850, 852; 854, 856; and 858, 860, respectively. Recesses 852 and 854 cooperate to define a space into which a user may place one of their fingers to grab either front plate 716 or front plate 718. Recesses 856 and 858 define an opening into which a user may insert a finger to grab either front plate 718 or front plate 720.

Two elastic bands 728 and 730 extend around the front of front plate 716 and around the back of back plate 722 above shelf 704 and recesses 850 and 852. Elastic bands 736 and 738 extend around the front of front plate 718 and the back of back plate 724 above shelf 706 and recesses 854 and 856. Elastic bands 744 and 746 extend around the front of front plate 720 and the back of back plate 726 above shelf 708 and recesses 858 and 860.

Elastic bands 728 and 730, front plate 716 and back plate 722 together define a contained area on shelf 704 in which objects may be placed such that the objects do not fall off shelf 704 but are allowed to extend over the sides of shelf 704 by stretching elastic bands 728 and 730 outward from the center of shelf 704. In some embodiments, the objects may stretch elastic bands 728 and 730 sufficiently for an object on shelf 704 to make contact with shelf 706. Similarly, elastic bands 736 and 738, front plate 718 and back plate 724 define a contained area on shelf 706 in which objects may be placed and elastic bands 744 and 746, front plate 720 and back plate 726 define a third contained area on shelf 708 in which objects may be placed. Elastic bands 736, 738, 744 and 746 may be stretched by the objects on their respective shelves allowing the objects to extend off the sides of the shelves but preventing the objects from falling off the shelves.

Attached between front plates 716 and 722 is a raised platform or shelf 710 that is above elastic band 730. Raised platform 710 is connected to front plate 716 and back plate 722 by fasteners such as screws 812 and 814 shown in FIG. 8. Above raised platform 710, elastic bands 732 and 734 extend around the front of front plate 716 and around the back of back plate 722 and above a left side and a right side of raised platform 710. Front plate 716, back plate 722, and elastic bands 732 and 734 define a contained area over raised platform 710 in which objects may be placed. Elastic bands 732 and 734 prevent objects in the contained area from falling off raised platform 710 but allow objects in the contained area to extend over the sides of raised platform 710 and in some embodiments allow the objects to make contact with a second raised platform 712 located between front plate 718 and back plate 724. Thus, elastic bands 732 and 734 may be stretched to accommodate objects placed on raised platform 710.

Raised platform 712 is secured to front plate 718 and back plate 724 by screws such as screws 816 and 818 of FIG. 8. Raised platform 712 is located above elastic bands 736 and 738. Elastic bands 740 and 742 extend around a front of front plate 718 and a back of back plate 724 above raised platform 712. Front plate 718, back plate 724 and elastic bands 740 and 742 define a contained area above raised platform 712 into which objects may be placed. Elastic bands 740 and 742 maintain the objects on raised platform 712 such that the objects do not fall off platform 712. However, elastic bands 740 and 742 may be stretched by objects placed on raised platform 712 so that the objects extend over the sides of raised platform 712 and in some cases make contact with raised platform 710 and/or raised platform 714. Raised platform 714 is located between front plate 720 and back plate 726 above elastic bands 744 and 746. In one embodiment, raised platform 714 is attached to front plate 720 and back plate 726 by screws, such as screws 820 and 822. Elastic bands 748 and 750 extend around the front of front plate 720 and the back of back plate 726 above raised platform 714. Elastic bands 748 and 750, front plate 720 and back plate 726 define a contained area over raised platform 714 into which objects may be placed. Elastic bands 748 and 750 may be stretched by objects placed on raised platform 714 allowing those objects to make contact with raised platform 712 while preventing those objects from falling off raised platform 714.

Each of slide mounts 824, 826 and 828 may be slid outward from base 702 independently of the other slide mounts. As a result, shelf 704 and raised platform 710 may be slid outward together on a same track of slide mount 824 while the remaining shelves and raised platforms remain within the cupboard. Similarly, shelf 706 and raised platform 712 may be slid outward and shelf 708 and raised platform 714 may be slid outward on respective tracks of slide mounts 826 and 828.

Front walls 716, 718 and 720 and back walls 722, 724 and 726, include notches into which elastic bands 728, 730, 732, 734, 736, 738, 740, 742, 744, 746, 748 and 750 reside. These notches maintain the elastic bands in position as objects are inserted and removed from the rack assembly. Under one embodiment, the notches have the same shape and dimensions as notches 220, 222, 224, and 226 of FIG. 6. In one embodiment, front plates 716, 718 and 720 and back plates 722, 724 and 726 are made of a plastic material such as PETG. Further, front plates 716, 718 and 720 are preferably transparent so that it is possible to see the items stored on the shelves and raised platforms.

Figure 11:
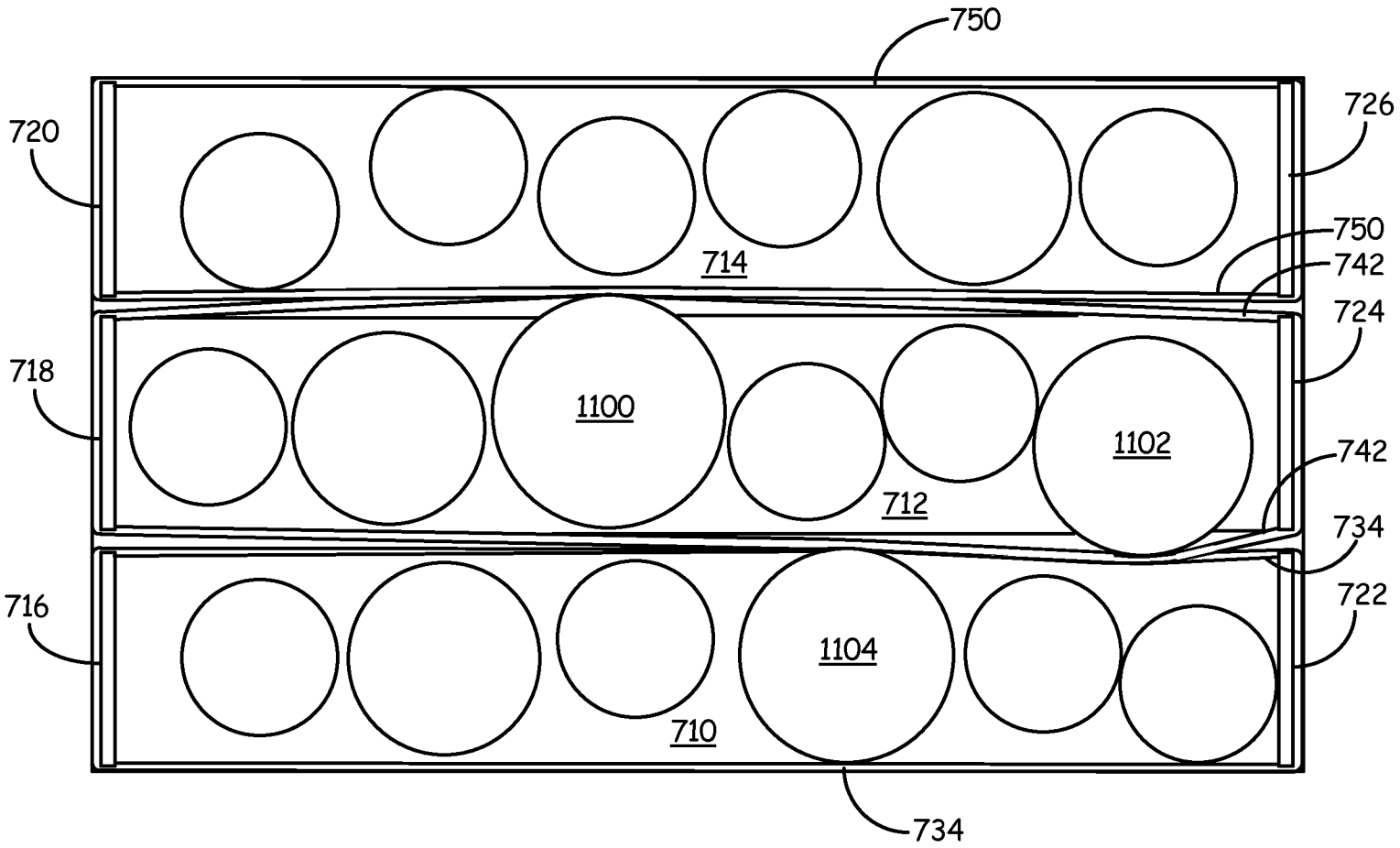
FIG. 11 is a top view of the rack assembly of FIG. 7 with items installed in the rack assembly.

FIG. 11 provides a top view of rack assembly 700 with items stored on raised platforms 710, 712 and 714. As shown in FIG. 11, an item 1100 on raised shelf 712 stretches elastic band 742 and extends off of raised platform 712 to make contact with platform 710. Similarly, item 1102 on platform 712 stretches elastic band 742 in the opposite direction from item 1100 allowing item 1102 to extend over the other side of raised platform 712. Item 1104 stretches elastic bands 734 and 742 allowing item 1104 to extend over the side of raised platform 710 to make contact with raised platform 712. Thus, as shown in FIG. 11, items placed in the contained areas defined by the elastic bands, the front plates and the back plates can stretch the elastic bands so that the items extend over the sides of the shelves or raised platforms and in some cases make contact with neighboring shelves or raised platforms.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms for implementing the claims.

What is claimed is:

1. A rack assembly comprising:
- a base configured to be mounted to a shelf within a cabinet;
- first and second slide mounts mounted to the base;
- first and second slides moveable on the first and second slide mounts, respectively;
- a first rack portion comprising:
  - a first bottom plate attached to the first slide;
  - a first front wall mounted to a front of the first bottom plate;
  - a first back wall mounted to a back of the first bottom plate; and
  - at least one first elastic element extending between the first front wall and the first back wall above a left side and a right side of the first bottom plate such that the first front wall, first back wall and at least one first elastic element define a first contained area capable of holding objects and such that the first rack portion has an open top; and
- a second rack portion comprising:
  - a second bottom plate attached to the second slide in parallel with the first base plate;
  - a second front wall mounted to a front of the second bottom plate;
  - a second back wall mounted to a back of the second bottom plate; and
  - at least one second elastic element extending between the second front wall and the second back wall above a left side and a right side of the second bottom plate such that the second front wall, second back wall and at least one second elastic element define a second contained area capable of holding objects and such that the second rack portion has an open top.

2. The rack assembly of claim 1 wherein the at least one first elastic element comprises a first elastic band that extends around a front surface of the first front wall and a back surface of the first back wall.

3. The rack assembly of claim 2 wherein the at least one first elastic element further comprises a second elastic band that extends around the front surface of the first front wall and the back surface of the first back wall and is spaced apart from the first elastic band.

4. The rack assembly of claim 3 wherein the first front wall comprises an upper pair of notches that receive the first elastic band and a lower pair of notches that receive the second elastic band.

5. The rack assembly of claim 4 wherein the first back wall comprises an upper pair of notches that receive the first elastic band and a lower pair of notches that receive the second elastic band.

6. The rack assembly of claim 3 further comprising:
- a third elastic band and a fourth elastic band extending around a front surface of the second front wall and a back surface of the second back wall such that the second front wall, second back wall, third elastic band and fourth elastic band define a second contained area capable of holding objects.

7. The rack assembly of claim 6 wherein the first and second front walls each comprises a pair of recesses on opposing sides of the first and second front walls, and wherein when the front surface of the first front wall and the front surface of the second front wall are aligned in a same plane, and a recess of the first front wall and a recess of the second front wall together define a space to allow a finger to be inserted between the first front wall and the second front wall.

8. The rack assembly of claim 1 wherein at least one of the first front wall or the second front wall further comprises a recess adjacent the other of the first front wall or the second front wall, which defines a space to allow a finger to be inserted between the first front wall and the second front wall.

9. The rack assembly of claim 1 wherein the first rack portion further comprises:
- a raised platform mounted to the first front wall and the first back wall above the at least one first elastic element; and
- a further elastic element extending between the first front wall and the first back wall above a left side and a right side of the raised platform such that the first front wall, first back wall and further elastic element define a second contained area capable of holding objects on the raised platform.

10. Shelves comprising:
- a base configured to be mounted to a shelf within a cabinet;
- first and second tracks mounted to the base;
- a first shelf that slides on the first track;
- a second shelf in parallel with the first shelf, wherein the second shelf slides on the second track;
- at least one first elastic element extending along opposing sides of the first shelf that retains items so that the items do not fall off the first shelf but allows the items to extend out from the first shelf to make contact with the second shelf such that an item that is wider than the first shelf contacts the at least one first elastic element on the opposing sides of the first shelf; and
- at least one second elastic element extending along opposing sides of the second shelf that retains items so that the items do not fall off the second shelf but allows the items to extend out from the second shelf to make contact with the first shelf such that an item that is wider than the second shelf contacts the at least one second elastic element on the opposing sides of the second shelf.

11. The shelves of claim 10 further comprising a first front panel and a first back panel attached to the first shelf wherein the at least one first elastic element extends between the first front panel and the first back panel.

12. The shelves of claim 11 wherein the at least one first elastic element comprises an elastic band that extends around the first front panel and the first back panel.

13. The shelves of claim 12 further comprising:

a second front panel and a second back panel attached to the second shelf; and the at least one second elastic element extends between the second front panel and the second back panel.

14. The shelves of claim 12 wherein the at least one second elastic element comprises an elastic band that extends around the second front panel and the second back panel.

15. The shelves of claim 10 further comprising a third shelf above the first shelf that slides with the first shelf on the first track.

16. A bin comprising:

a base configured to be mounted to a shelf within a cabinet;

first and second slide mounts on the base;

a first bottom plate attached to the first slide mount such that the first bottom plate can slide out of the cabinet;

a first front plate mounted to the first bottom plate and extending upward from the first bottom plate;

a first back plate mounted to the first bottom plate and extending upward from the first bottom plate; and a first elastic band extending around a front of the first front plate and a back of the first back plate such that the bin has an open top;

a second bottom plate attached to the second slide mount such that the second bottom plate can slide out of the cabinet;

a second front plate mounted to the second bottom plate and extending upward from the second bottom plate;

a second back plate mounted to the second bottom plate and extending upward from the second bottom plate; and a second elastic band extending around a front of the second front plate and a back of the second back plate.

17. The bin of claim 16 further comprising a raised platform mounted to the first front plate and the first back plate above the first elastic band.

18. The bin of claim 17 further comprising a third elastic band extending around the front of the first front plate and the back of the first back plate above the raised platform.

19. The bin of claim 18 wherein the first and second front plates are transparent.

* * * * *